US010532843B2

(12) United States Patent
Grassi et al.

(10) Patent No.: US 10,532,843 B2
(45) Date of Patent: Jan. 14, 2020

(54) DEVICE AND METHOD FOR CHECKING THE QUALITY OF EXTENSIBLE FILM FOR PACKAGING

(71) Applicant: Bema S.r.l., Viano (IT)

(72) Inventors: Antonio Grassi, Viano (IT); Stefano Bertelli, Viano (IT)

(73) Assignee: BEMA S.R.L., Viano (RE) (IT)

( * ) Notice: Subject to any disclaimer, the term of this patent is extended or adjusted under 35 U.S.C. 154(b) by 633 days.

(21) Appl. No.: 15/023,454

(22) PCT Filed: Sep. 19, 2014

(86) PCT No.: PCT/IB2014/064671
§ 371 (c)(1),
(2) Date: Mar. 21, 2016

(87) PCT Pub. No.: WO2015/040585
PCT Pub. Date: Mar. 26, 2015

(65) Prior Publication Data

US 2016/0229573 A1 Aug. 11, 2016

(30) Foreign Application Priority Data

Sep. 20, 2013 (IT) ..... VR2013A0218

(51) Int. Cl.
*B65B 57/04* (2006.01)
*B65B 41/16* (2006.01)
*B65B 45/00* (2006.01)

(52) U.S. Cl.
CPC ..... *B65B 57/04* (2013.01); *B65B 41/16* (2013.01); *B65B 45/00* (2013.01)

(58) Field of Classification Search
CPC ..... B65B 57/04; B65B 11/02; B65B 11/04; B65B 41/16; B31B 50/02; B31B 50/022–12; B65H 16/00–106
(Continued)

(56) References Cited

U.S. PATENT DOCUMENTS 4,496,417 A * 1/1985 Haake ..... B32B 27/10 156/361
4,682,038 A * 7/1987 Focke ..... B65B 57/02 250/548

(Continued)

FOREIGN PATENT DOCUMENTS

GB 2192853 1/1988

*Primary Examiner* — Gloria R Weeks
*Assistant Examiner* — Dariush Seif
(74) *Attorney, Agent, or Firm* — Tutunjian & Bitetto, P.C.

(57) ABSTRACT

A device for checking the quality of extensible film for wrapping purposes available in reels, operatively associable to a wrapping machine. The device supports at least one reel of extensible film, including at least one storage memory of a plurality of wrapping programs of a palletized load, each characterised by different operating parameters to carry out the wrapping operation, and detects at least one parameter representative of the quality of the film on the reel and measures instant by instant, the present diameter of the reel. An electronic processor, operatively associated with the storage memory, is provided suitable for selecting and/or changing a given wrapping program according to at least the parameter representative of the quality of the film on the reel. A method to inspect the quality of the packaging stretch film available in reels.

19 Claims, 2 Drawing Sheets

(58) Field of Classification Search
USPC ..... 53/64, 389.4, 396; 493/3; 226/11
See application file for complete search history.

(56) References Cited

U.S. PATENT DOCUMENTS 5,036,706 A * 8/1991 Gnuechtel ..... B65H 26/025 340/675
5,308,010 A * 5/1994 Hakiel ..... B65H 18/26 226/21
5,771,547 A * 6/1998 Hommes ..... B29C 55/20 26/93
5,820,065 A * 10/1998 Altosaar ..... B65H 19/28 242/534
5,966,218 A * 10/1999 Bokelman ..... G01N 21/95 356/429
8,001,745 B2 * 8/2011 Carter ..... B65B 11/025 53/389.4
8,403,251 B2 * 3/2013 Uozumi ..... B29C 53/8016 242/419.3
9,415,963 B2 * 8/2016 Haque ..... B65H 23/038
9,725,195 B2 * 8/2017 Lancaster, III ..... B65B 11/025
10,053,253 B2 * 8/2018 Lancaster, III ..... B65B 57/04
2003/0089864 A1 * 5/2003 Ramm ..... A01F 15/071 250/559.42
2003/0093971 A1 * 5/2003 Terminella ..... B65B 9/20 53/133.4
2003/0189118 A1 * 10/2003 Smith ..... B65H 18/28 242/160.4
2007/0081715 A1 * 4/2007 Chaput ..... B65H 23/0204 382/152
2008/0307754 A1 * 12/2008 Storig ..... B65B 11/008 53/461
2009/0030544 A1 * 1/2009 Floeder ..... G01N 21/8851 700/122
2009/0060316 A1 * 3/2009 Ruuska ..... B65H 26/025 382/141
2009/0293425 A1 * 12/2009 Carter ..... B65B 11/025 53/167
2010/0063750 A1 * 3/2010 Floeder ..... G01N 21/89 702/35
2010/0163443 A1 * 7/2010 Storig ..... B65B 11/008 206/223
2010/0231897 A1 * 9/2010 Hofeldt ..... B65H 20/00 356/73
2011/0037221 A1 * 2/2011 Wiegmann ..... B43M 3/04 271/270
2011/0131927 A1 * 6/2011 Lancaster, III ..... B65B 11/025 53/461
2011/0240789 A1 * 10/2011 Schoenberg ..... G01N 33/346 242/523.1
2012/0102887 A1 * 5/2012 Lancaster, III ..... B65B 11/025 53/461
2013/0135729 A1 * 5/2013 Hirata ..... B29D 11/0073 359/492.01
2013/0203580 A1 * 8/2013 Lenser ..... A61F 13/15747 493/442
2014/0209655 A1 * 7/2014 Haque ..... B65H 23/0204 226/15
2014/0223863 A1 * 8/2014 Lancaster, III ..... B65B 11/008 53/436
2015/0353220 A1 * 12/2015 Lancaster, III ..... B65B 57/18 53/461
2016/0098171 A1 * 4/2016 Lancaster, III ..... B65B 57/04 715/835

* cited by examiner

DEVICE AND METHOD FOR CHECKING THE QUALITY OF EXTENSIBLE FILM FOR PACKAGING

TECHNICAL FIELD OF THE INVENTION

The present invention concerns a device and a method for checking the quality extensible film for packaging.

More specifically, the invention concerns a device and method to control the quality of extensible film for wrapping palletized loads and the like.

DESCRIPTION OF THE PRIOR ART

In the packaging field, for example, in appliances for wrapping palletized loads and the like, extensible film made of polymeric material available as reels is used.

As known, load wrapping is performed by wrapping machines on to which the reel of extensible film is loaded.

In this type of appliances, a very important parameter is the wrapping machines productivity, i.e. the number of palletized loads that can be properly wrapped in a time unit.

As it can be guessed, this parameter is strongly influenced by the quality of the extensible film used to wrap the load.

In fact, if the film is of low quality and/or if the wrapping parameters are not the correct ones according to the quality of the film itself, the latter may tear or break, even several times during wrapping.

Consequently to this event, it is necessary to re-set the machine to restore it to proper operating conditions, wasting time and resources.

A general feeling in the field is therefore the need to have means and technologies suitable for increasing the productivity of the wrapping machines, as well as means and technologies suitable for limiting the problems caused by the tearing or breaking of the extensible film during the wrapping operations.

SUMMARY OF THE INVENTION

The technical aim of the present invention is therefore to improve the state of the art.

Within this technical aim, a purpose of the present invention is to develop a device and a method for checking the quality of extensible film for packaging so as to reduce the film damage or breaking during the wrapping operations.

This aim and purpose are achieved by the wrapping film quality checking device according to the present principles.

The device according to the invention, that is operatively associable to a wrapping machine comprising means for supporting at least one reel of extensible film, comprises at least one storage memory of a plurality of wrapping programs of a palletized load or the like, each characterized by different operating parameters to carry out the wrapping operation, means for detecting at least one representative parameter of the quality of the film of the reel, means for measuring, instant by instant, the current diameter of the reel, an electronic processor, operatively associated with the storage memory, with said detection means and with said measuring means, suitable for selecting and/or changing a particular wrapping program according to at least said representative parameter of the quality of the film on the reel. Moreover, this aim and purpose are achieved by the wrapping extensible film quality checking method according to the present principles.

The present specification refers to advantageous embodiments of the invention.

BRIEF DESCRIPTION OF DRAWINGS

These and further advantages will be better understood by any man skilled in the art from the following description and the attached drawings, provided by way of non-limiting example, in which.

DETAILED DESCRIPTION

Figure 1:
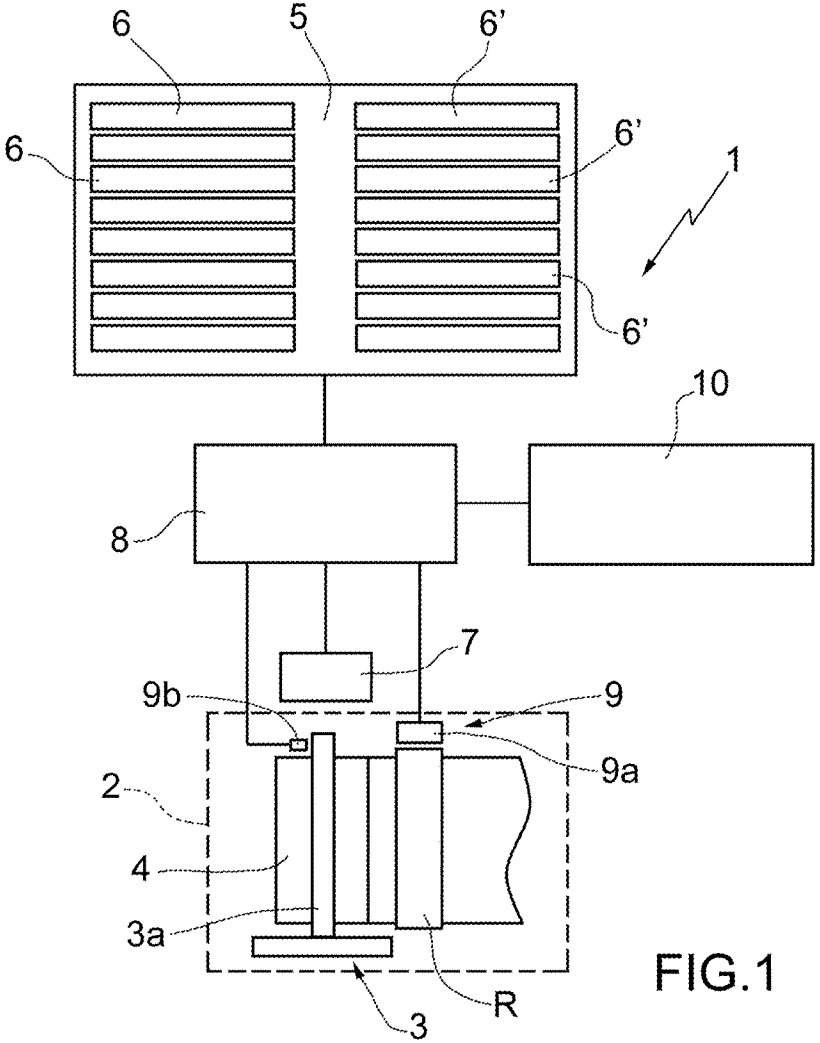
FIG. 1 is a schematic representation of the device according to the invention.

With reference to FIG. 1, a device for checking the quality of packaging film according to the present invention is globally and schematically indicated with 1.

The device according to the invention is particularly suitable for appliances with extensible film for packaging available in reels.

The device 1 is operatively associable with a machine for wrapping palletised loads and the like, schematically indicated by 2 in FIG. 1.

The wrapping machine 2 comprises support means 3 of at least one coil 4 of extensible film. The support means 3 comprise a spindle 3*a* along which the reel 4 is mounted. Furthermore, the wrapping machine 2 comprises a device for unwinding and pre-stretching the extensible film for its application around a palletized load.

The unwinding and pre-stretching device is associated to the support means 3 of the reel 4.

One of the rollers R of the unwinding and pre-stretching device is schematically shown in FIG. 1. The wrapping machine 2 and the support means 3 will not be further described, as they are of a type essentially known in the field.

The unwinding and pre-stretch device will not be further described in detail, since it does not form part of the present invention.

Only as an example and not by way of limitation, it is specified that the device 1 may be partially or completely embedded in an existing wrapping machine 2, and also partially or completely in the existing processing and control unit of the same wrapping machine 2.

Alternatively, the device 1 can be operatively connected to said processing and control unit, but separated from it.

According to an aspect of the present invention, the device 1 comprises at least one storage memory 5 of a plurality of wrapping programs 6,6' of a palletized load or the like.

As it will be clarified hereinafter, each of wrapping programs 6,6' is characterized by different operating parameters.

According to a further aspect of the invention, the device 1 comprises means of detection 7 of at least one representative parameter of the quality of the film of the reel 4.

According to yet another aspect of the invention, the device 1 comprises an electronic processor 8.

The electronic processor 8 is operatively associable with the memory storage 5 and the means of detection 7.

As it will be better clarified hereinafter, the electronic processor 8 is suitable for selecting, or possibly changing, a given wrapping program 6,6' provided in the storage memory 5 according to at least said parameter representative of the quality of the film on the reel 4.

The electronic processor 8 can also be, in some embodiments, the same electronic processor that manages and controls the operation of the wrapping machine 2.

Alternatively, the electronic processor 8 can be distinct and separate from that of the wrapping machine 2.

According to the embodiment of the device 1 shown in FIG. 1, the wrapping programs 6,6' comprise at least a first program 6 set with operating parameters suitable for operating with high-quality extensible film.

Moreover, the wrapping programs 6,6' comprise at least a second program 6' set with operating parameters suitable for operating with low quality film.

More in detail, in one embodiment of the invention, the wrapping programs 6,6' include a number of first programs 6 set with operating parameters suitable for operating with high quality extensible film, and a same number of second programs 6' set with operating parameters suitable for operating with low quality film.

Preferably, the first programs 6 and the second programs 6' are set in such a way as to define pairs of first and second programs 6,6' corresponding to each other.

In other words, to each one of the first programs 6 a respective second program 6', with at least some of the operating parameters adequately adjusted to operate with low quality film, corresponds.

According to yet another aspect of the present invention, said parameter representative of the quality of the film on the reel 4 is constituted by the number of tears or breaks of the film found on the same reel 4, during the wrapping operations.

In particular, during operating conditions, a predetermined threshold value of the number of tears or breaks found in the same reel 3 during the wrapping operations is determined—for example, in an experimental way, or in another way.

This threshold value of the number of tears or breaks is considered suitable for distinguishing high quality extensible films from low quality ones.

This threshold value can be set by the user, for example, according to his knowledge and his experience.

Consequently, the first wrapping program 6—or the plurality of first wrapping programs 6—is selectable by the electronic processor 8 when the number of tears or breaks occurred in a same reel 4 is lower than the aforementioned predetermined threshold value.

Moreover, the second wrapping program 6'—or the plurality of second wrapping programs 6'—is selectable by the electronic processor 8 when the number of tears or breaks occurred in a same reel 4 is higher than the aforementioned predetermined threshold value.

The operating parameters—which distinguish the wrapping programs 6,6' to each other—comprise at least the pre-stretching and pulling or tensioning of the extensible film applied to the palletized load during the wrapping operation. These are in fact the basic parameters that usually characterize the wrapping operation of a palletized load, or the like.

In other embodiments of the invention the wrapping programs 6,6' can also be set on the basis of other operating parameters chosen by the user, without any special limitation to the objects of the present invention.

Normally, the first wrapping program 6—or the plurality of first wrapping programs 6—is set to operate with pre-stretching and tensioning values higher than those set in the second wrapping program 6' or in the plurality of second wrapping programs 6'.

Only as an example, high quality extensible films can be used up to a pre-stretch value of around 350-400% while keeping the number of tears or breaks within the desired limit.

As for low quality extensible films, they can normally be used up to a pre-stretch value not exceeding 200-250% in order to keep the number of tears or breaks within the desired limit.

Therefore, within each of the above mentioned pairs of wrapping programs 6,6', each first and second program 6,6' differ from each other at least by the pre-stretch and pull values applied to the extensible film.

According to a further characteristic of the present invention, the device 1 comprises means 9 for the measurement, instant by instant, of the diameter or circumference of the reel 4 of extensible film, i.e. means for the measurement of the diameter or present circumference of the reel 4 during wrapping operations.

The instant by instant measurement of the diameter or circumference of the reel 4 allows several important functions to be performed to check the quality of the extensible film, as will be clarified hereinafter.

In one embodiment of the invention, the measurement means 9 directly detect the length of the circumference of the reel 4.

In particular, the measurement means 9 of the current circumference of the reel 4 allow the current diameter of the reel 4 to be also indirectly measured instant by instant, as will be clarified hereinafter.

The measurement means 9 of the diameter or current circumference of the reel 4 may be of any type suitable for the present application, for example they may be mechanical, electronic, or of another other type.

The measurement means 9 are operatively associated with the electronic processor 8.

The measurement means 9 comprise a first sensor 9*a* associated with one of the rollers R of the unwinding and pre-stretching device of the wrapping machine 2.

The first sensor 9*a* can for example consist in an encoder, associated with one of the rollers R of the unwinding and pre-stretching device of the wrapping machine 2.

Furthermore, the measurement means 9 comprise a second sensor 9*b*, associated with the means of support 3 of the reel 4.

In particular, the second sensor 9*b* is associated with the spindle 3*a* supporting the reel 4.

The second sensor 9*b* is of the type suitable for detecting the number of revolutions of the spindle 3*a*, and therefore, of the reel 4 itself.

For example, the second sensor 9*b* may be a proximity sensor, which detects the passage of a specific portion of the external surface of the spindle 3*a*. The second sensor 9*b* may however be of any other type suitable for detecting the number of revolutions of the spindle 3*a*, and therefore, of the reel 4.

As said above, the measurement means 9 are able to detect, instant by instant, the length of the circumference of the reel 4 by processing the measurements of the first sensor 9*a* and the second sensor 9*b*.

More in detail, since the diameter of the roller R is known and constant, the first sensor 9*a* is able to determine the length of the film unwound from the reel 4 for each revolution of the spindle 3*a*, thanks precisely to the detection of the number of revolutions completed by the roller R for each revolution of the spindle 3*a* itself.

By knowing the circumference of the reel 4, instant by instant, it is then possible to know the value of the diameter of same, instant by instant.

In other embodiments, the measurement means 9 may be of a type able to directly detect, i.e. instant by instant, the current diameter of the reel 4.

By the direct measurement of the current diameter of the reel 4 the knowledge of the length of the current circumference of same can then indirectly derive.

The measurement means 9 of the current diameter of the reel 4 may be of any known type and suitable for application to the specific solutions described in the present invention.

According to a further aspect of the present invention, the device 1 comprises a statistical and/or historical memory 10, operatively associated with the electronic processor 8.

The statistical and/or historical memory 10 is able to store information and calculate evaluations on the quality of the extensible film of the reels 4 used in the wrapping machine 2, and on the effectiveness of the wrapping programs 6.6'.

According to a further aspect of the present invention, the measurement means 9 are also able to detect the thickness of the film.

This detection is important as the film is supplied with a thickness tolerance usually of 5%, and this detection therefore allows the user to verify if the film thickness specified in the supply agreement has not been complied with.

The detection of the film thickness is performed by successive measurements of the circumference of the reel 4, taken at regular revolution intervals of the reel 4 itself, for example every 5-10 revs.

In particular, by means of the second sensor 9*b* it is possible to measure, at regular intervals, the length of the unwound film for a certain number of revolutions of the reel 4; in other words, by this measurement it is possible to determine, by an appropriate calculation, the reduction in the circumference of the reel 4 for an unwinding of, for example, 5-10 revolutions.

This data, then evaluated in relation to the number of revolutions of the reel 4 and the constant 2*n*, enables to know the film thickness of the reel 4 unwound for the above number of revolutions, and therefore, to know if this data is or not within the tolerance required.

It is essentially an average detection of a given section of the film, sufficient, however, to make the necessary assessments on the quality of the film of the reel 4.

Furthermore, any significant changes in the thickness of the film of a same reel 4 may be detected.

Figure 2:
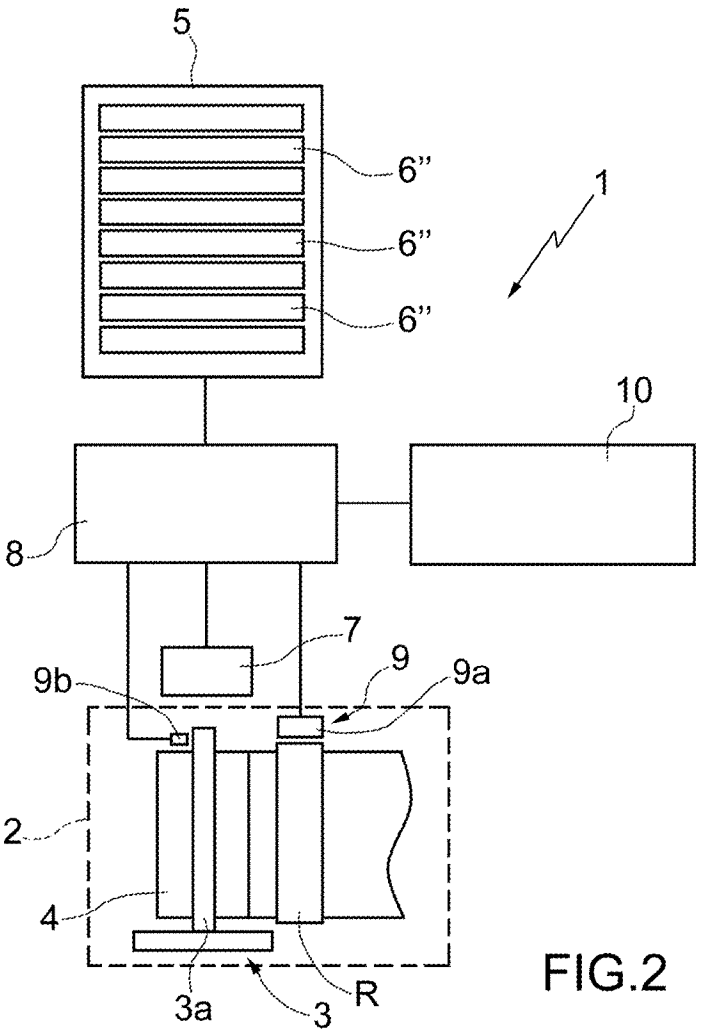
FIG. 2 is a schematic representation of the device according to the invention, in another embodiment.

In FIG. 2 an alternative embodiment of the device 1 according to the invention is schematically shown, in which the storage memory 5 includes a plurality of wrapping programs 6" that are set to operating parameters that can be modified in real time.

In particular, according such wrapping programs 6", at least the pre-stretch and pull values can be modified in real time in relation to the quality level of the extensible film used.

The detection means 7 of the parameter representative of the quality of the extensible film can be of any type suitable for the present application, for example mechanical, electronic, or of other types, without any limitation.

In the following a method to inspect the quality of the packaging extensible film available in reels 4 is disclosed.

The method is applicable to a wrapping machine 2 comprising support means 3 of a least a reel 4 of extensible film.

The present method can be applied through a device 1 like the one described here above, or also through a device with different characteristics.

In particular, the method according to the invention can be completely, or even just partially, implemented by the electronic processor 8 of the device 1 previously described. Alternatively, the method can be implemented by another electronic processor, for example, the electronic processor of a wrapping machine 2 for palletized loads.

Consequently, a computer program to carry out, completely or even just partially, the described method is also a subject-matter of the invention.

The above computer program is contained in a physical medium readable by an electronic processor, or the like.

The physical medium can be for example the memory of a computer, or the memory of the electronic processor of the wrapping machine 2, or a similar machine.

The physical medium may also be a portable memory medium, such as a compact disk, a memory stick, a memory card, or the like, readable by an electronic processor, such as the processor of the wrapping machine 2.

The aforementioned computer program can operate according to several different modes, but it is in any case suitable for implementing all the described steps, or even just some of them.

According to the method, a step is provided—either initial or preparatory—to supply a plurality of wrapping programs 6,6', each characterised by different operating parameters.

Figure 3:
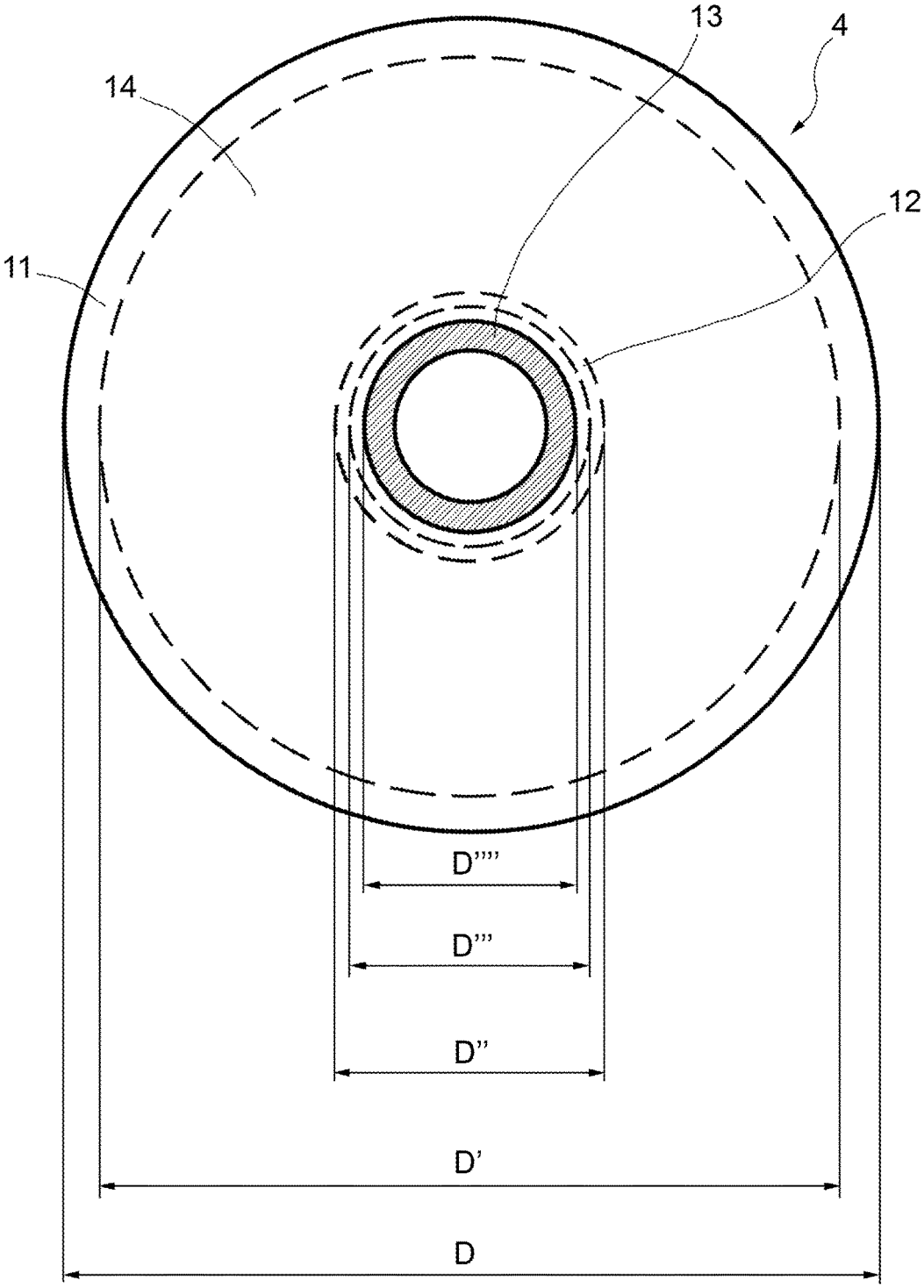
FIG. 3 is a sectional view of a reel of extensible film used by the device and the method according with the present invention.

To understand how the present method is applied in a preferred embodiment, reference should be made to FIG. 3, which illustrates a cross section of a reel 4 of extensible film.

The reel has an outside diameter D.

As shown in the above FIG. 3, the extensible film of the reel 4 comprises an outer crown 11.

By the definition of outer crown 11 it is meant an initial layer of film on the reel 4—with, for example, a thickness of a few millimetres—in which the tears or breaks are usually very frequent, and normally not indicative of a low quality of the extensible film.

The outer crown 11 is comprised between the outside diameter D and a first diameter D'.

In addition, the extensible film of the reel 4 comprises an inner crown 12.

By the definition of inner crown 12 it is meant an end layer of film on the reel 4—with, for example, a thickness of a few millimetres—no longer effectively usable to carry out the wrapping of the palletised load, thus indicating that the reel 4 is about to run out.

The inner crown 12 is comprised between a second diameter D" and the diameter of the core 13 of the reel 4.

A third diameter D"' can also be identified, smaller than the diameter D", which defines the last portion of the film, not sufficient to perform the wrapping of the palletised load. The fourth diameter D"", which corresponds to the diameter of the core 13 of the reel 4, is also known.

The method provides a step of measuring, instant by instant, the current diameter or current circumference of the reel 4 of extensible film during the wrapping operation.

Through the measurement, instant by instant, of the current diameter or current circumference of the reel 4, it is possible to determine if the reel 4 itself, during its unwinding, is delivering film comprised in its outer crown 11, or in its inner crown 12, or even in its central crown 14.

By central crown 14, or core, of the reel 4 it is meant the crown comprised between the first diameter D' and the second diameter D".

The method then provides a step for detecting at least one parameter representative of the quality of the extensible film of the reel 4.

The above parameter representative of the quality of the extensible film of the reel 4 is given in particular by the number of tears or breaks of the film found in the same reel 4, during the wrapping operations.

The method also provides a step of selection of a given wrapping program 6,6' in relation to the said parameter representative of the quality of the extensible film of the reel 4, detected during the wrapping operation.

As said, the wrapping programs 6,6' include, more particularly, a plurality of first programs 6 set with operating parameters—film pre-stretching and pull—suitable for operating with high quality extensible film, and a plurality of seconds programs 6' set with operating parameters suitable for operating with low quality extensible film.

In practical operation, then, during the palletized load wrapping operation, the current diameter, or current circumference of the reel 4, is detected instant by instant, as the extensible film is dispensed from the same reel.

Initially the film is dispensed from the outer crown 11: as mentioned here above, the film in the outer crown 11 tends to break rather frequently even if it is of high quality.

For this reason, one of the second programs 6' set with parameters suited to operating with low quality film is initially selected as the default setting.

In addition, one of the second programs 6' is selected even when there is no information available on the current diameter, or current circumference, of the reel 4.

Until the film is dispensed from the outer crown 11—this information is obtained by measuring the current diameter, or current circumference, instant by instant—any tears or breaks in the film itself are not taken into account.

The counting of the tears or breaks of the extensible film is instead carried out when the film is delivered from the central crown 14 of the reel 4.

The wrapping operation then continues in accordance with the second program 6' set, by counting the tears or breaks, until the reel 4 has an outside diameter equal to D".

According to an interesting aspect of the present invention, the above second program 6' set can be kept operating on the condition that a certain amount of wrapped palletized loads and/or a certain amount of reels 4 of the same extensible film is completed without any tears or breaks occurring.

This fact can be understood as indicative of high quality extensible film.

Clearly, the number of completed reels 4 and/or the number of wrapped palletized loads without any tears or breaks occurring can be set by the user.

As a result, one of the first programs 6 set with parameters suitable for operating with high quality films can be automatically selected.

For example, the first program 6 can be selected, coupled to the previously operating second program 6'.

As the wrapping operations continue according to one of the first programs 6, in the event that a certain amount of tears or breaks has occurred in a same reel 4, higher than a certain pre-set threshold value, one of the second programs 6' is automatically selected again, set with parameters suitable for operating with low quality film.

For example, the second program 6' can be selected, coupled to the previously operating first program 6.

A necessary condition for such second program 6' to be selected is that the current diameter of the reel 4 is comprised within the central crown 14 of the reel itself.

According to the present method, then, the wrapping operations continue so that the wrapping program 6,6' most suitable for operating with the detected quality film is automatically selected.

Obviously, in an attempt to optimize production times and reduce costs, the method is designed in such a way as to operate as much as possible in agreement with one of the first wrapping programs 6, i.e. with high quality films.

This results into considerable material savings.

The method also includes a phase of statistical and/or historical information storage and assessment processing regarding the quality of the extensible film of the reels 4 used in the wrapping machine 2, and the effectiveness of the wrapping programs 6,6'.

For example, for each one of the wrapping programs 6,6' stored, the number of palletized loads wrapped with that program 6,6', the breaks reckoned during the running of the program 6,6', the breaks reckoned during the running of the next program 6,6', the average wrapping weight and other are stored in the memory.

For each wrapping head provided in the wrapping machine 2, the total number of breaks, the total number of completed reels 4, the average number of breaks per reel 4, for example, are stored.

To this regard, it is specified that a reel 4 is considered completed when the actual diameter detected is smaller than the third diameter D'''.

The above mentioned parameters can supply accurate information on the average consumption of extensible film for each palletized load.

The method is able to autonomously detect the replacement of a reel 4 with another on the basis of the changes detected in the current diameter or the current circumference.

In this way, the need for an operator to intervene and set the reel 4 changeover, which could also cause errors, is eliminated.

For the reel 4 in use on the wrapping machine 2 at a certain time, the reckoned breaks, the amount of residual film, and the type of reel 4, i.e. whether it contains extensible film of high quality or low quality, are also stored. Furthermore, the number of loaded reels 4, the number of reels 4 used until the inner crown 12 is reached, and more, is stored.

By processing all the statistical and historical data stored, it is possible to obtain important information on the effectiveness of the wrapping programs 6,6' and the quality of the extensible films used, such as:

the average number of breaks for reel 4, which provides a qualitative indication on the overall system, the goal is obviously the reduction of this number;

the average number of breaks on each day;

the total number of high quality reels 4;

the total number of low quality reels 4;

the percent value of low quality reels with respect to the total number of completed reels 4;

the film weight for each palletized load;

the diameter of each reel 4 at each wrapping cycle end of a wrapped palletized load;

the number of film breaks for each wrapped palletized load;

the total number of reels 4 used, for example distinguishing between totally or partially used reels, new or old reels etc.;

the total number of reels 4 completely used up to the diameter D'''';

the measure of the average film thickness for a certain number of revolutions of the reel 4;

the measure of the average film thickness for a portion of film of pre-set length; the percent value of palletized loads wrapped with low quality reels for each pair of wrapping programs 6,6', which enables to detect quality issues of the film associated with specific programs 6,6' or products;

the percentage deviation between the total weight of the reels 4 used and the total weight of the film applied to correctly wrapped palletized loads.

All the above information can then be entered and organised in a special log, that is, each piece of information may be accompanied by a corresponding date and time indication, and/or possibly by an indication of the corresponding air temperature and humidity, and/or other indications. This can provide useful indications on certain film behaviours during wrapping operations.

With reference to the embodiment of the device 1 illustrated in FIG. 2, the method according to the invention provides that, during the wrapping operations performed according to a given program 6", on exceeding a threshold value for the number of tears or breaks occurred in a same reel 4, the values of the operating parameters of the program 6" itself are automatically modified.

Preferably, therefore, the pre-stretch and pull values of the extensible film are lowered, so as to bring them to values suitable for operating with low quality film.

It should be noted that, in the embodiments of the invention described above, the parameter representative of the quality of the film of the reel 4 may be a parameter other than that indicated, chosen according to theoretical and/or empirical considerations on the behaviour of the extensible film during the wrapping operations, without any limitation. It has thus been seen how the invention achieves the intended purposes.

The device and method according to the invention enable to monitor and assess, also in real time during production, the quality of the extensible film used in a wrapping machine, so as to set the correct operating parameters to minimise the number of tears and breaks. Consequently, the user of the machine can perform historical and statistical assessments on the use of a certain number of reels of extensible film in wrapping operations, thus being able to formulate, for example, judgements on the quality of the extensible film supplied by a given manufacturer. In addition, the user of the machine can carry out assessments in terms of material consumption per wrapped load unit, and therefore can make precise estimates of the production costs associated with each correctly wrapped palletized load.

The present invention has been described according to preferred embodiments, but various equivalent versions are possible still within the scope of the appended claims.

The invention claimed is:

1. A device for checking the quality of extensible film for packaging available in reels, operatively associable with a wrapping machine comprising support means of at least one reel of extensible film, comprising:

at least one storage memory of a plurality of wrapping programs of a palletized load, each distinguished by different operating parameters for carrying out the wrapping operation;

means for detecting at least one parameter representative of the quality of the film of the reel, wherein said parameter representative of the quality of the film of the reel consists of the number of tears or breaks of the film counted when the film is delivered from a central crown of the reel during the wrapping operations;

means for measuring, instant by instant, the current diameter, or the current circumference, of the reel, said measuring means being of the direct or indirect type; and an electronic processor, operatively associated with said storage memory, with said detection means and with said measuring means, suitable for selecting and/or modifying a certain wrapping program in relation to at least said parameter representative of the quality of the film of the reel, wherein said operating parameters comprise at least a pre-stretch value of the extensible film applied in the wrapping operation, wherein at least said pre-stretch value is modified based on the quality of the film.

2. The device according to claim 1, wherein said wrapping programs comprise at least one first program set with operating parameters suitable for operating with high-quality extensible film, and at least one second program set with operating parameters suitable for operating with low-quality film.

3. The device according to claim 2, wherein said first wrapping program can be selected when said number of tears is lower than a predetermined threshold value.

4. The device according to claim 2, wherein said second wrapping program can be selected when said number of tears is higher than a predetermined threshold value.

5. The device according to the claim 2, wherein said first wrapping program is set to operate with higher pre-stretch and tension values than those set in said second wrapping program.

6. The device according to claim 1, wherein said operating parameters comprise at least the pre-stretch and the pull or tension of the extensible film applied in the wrapping operation.

7. The device according to claim 1, comprising a statistical or historical memory operatively associated with said electronic processor, suitable for storing information and for processing evaluations on the quality of the extensible film of the reels used on the wrapping machine and on the efficiency of said wrapping programs.

8. The device according to claim 1, operatively associable with a wrapping machine comprising a device for unwinding and pre-stretching the film equipped with at least one roller, wherein said means for measuring the current circumference of the reel comprise a first sensor associated with one of the rollers and a second sensor associated with the spindle of the support means of the reel, of the type suitable for detecting the number of revolutions of said spindle, and thus of the reel itself, said first sensor and said second sensor being operatively associated with said electronic processor.

9. A method for checking the quality of extensible film for packaging available in reels, applicable onto a wrapping machine comprising support means of at least one reel of extensible film, wherein the method comprises the steps of:

providing a plurality of wrapping programs of a palletized load, each distinguished by different operating parameters for carrying out the wrapping operation;

detecting at least one parameter representative of the quality of the film of the reel, wherein said parameter representative of the quality of the film of the reel consists of the number of tears or breaks of the film counted when the film is delivered from a central crown of the reel during the wrapping operations;

measuring, instant by instant, the current diameter, or the current circumference, of the reel; and selecting and/or modifying a certain wrapping program in relation to at least said parameter representative of the quality of the film of the reel, wherein said operating parameters comprise at least a pre-stretch value of the extensible film applied in the wrapping operation, further comprising the step of modifying at least said pre-stretch value based on the quality of the film.

10. A method according to claim 9, wherein said wrapping programs comprise at least one first program distinguished by operating parameters suitable for operating with high-quality extensible film, and at least one second program distinguished by operating parameters suitable for operating with low-quality film.

11. The method according to claim 10, wherein said first wrapping program can be selected when said number of tears is lower than a predetermined threshold value.

12. The method according to claim 10, wherein said second wrapping program can be selected when said number of tears is higher than a predetermined threshold value.

13. The method according to claim 9, wherein said operating parameters comprise at least the pre-stretching and the pulling or the tensioning of the extensible film applied in the wrapping operation.

14. The method according to claim 9, wherein said first wrapping program is set to operate with higher pre-stretch or stretch and tension values than those set in said second wrapping program.

15. The method according to claim 9, comprising a step of storing information and of processing evaluations on the quality of the extensible film of the reels used on the wrapping machine and on the efficiency of said wrapping programs.

16. A processor adapted to carry out the steps of:

providing a plurality of wrapping programs of a palletized load, each distinguished by different operating parameters for carrying out the wrapping operation;

detecting at least one parameter representative of the quality of the film of the reel, wherein said parameter representative of the quality of the film of the reel consists of the number of tears or breaks of the film counted when the film is delivered from a central crown of the reel during the wrapping operations;

measuring, instant by instant, the current diameter, or the current circumference, of the reel; and selecting and/or modifying a certain wrapping program in relation to at least said parameter representative of the quality of the film of the reel, wherein said operating parameters comprise at least a pre-stretch value of the extensible film applied in the wrapping operation, further comprising the step of modifying at least said pre-stretch value based on the quality of the film.

17. A computer-readable non transitory medium executed by a computer comprising instructions which, when executed by the computer, cause the computer to carry out steps of:

providing a plurality of wrapping programs of a palletized load, each distinguished by different operating parameters for carrying out the wrapping operation;

detecting at least one parameter representative of the quality of the film of the reel, wherein said parameter representative of the quality of the film of the reel consists of the number of tears or breaks of the film counted when the film is delivered from a central crown of the reel during the wrapping operations;

measuring, instant by instant, the current diameter, or the current circumference, of the reel; and selecting and/or modifying a certain wrapping program in relation to at least said parameter representative of the quality of the film of the reel, wherein said operating parameters comprise at least a pre-stretch value of the extensible film applied in the wrapping operation, further comprising the step of modifying at least said pre-stretch value based on the quality of the film.

18. The computer program according to claim 17, contained in a physical support able to be read by an electronic processor.

19. The computer program according to claim 18, wherein said electronic processor is comprised in a wrapping machine.

* * * * *